US005363014A

United States Patent [19]

Nakamura

[11] Patent Number: 5,363,014

[45] Date of Patent: Nov. 8, 1994

[54] PHOTOMULTIPLIER

[75] Inventor: Kimitsugu Nakamura, Hamamatsu, Japan

[73] Assignee: Hamamatsu Photonics K.K., Hamamatsu, Japan

[21] Appl. No.: 965,721

[22] Filed: Oct. 23, 1992

[30] Foreign Application Priority Data

Oct. 24, 1991 [JP] Japan ..... 3-277792

[51] Int. Cl.[5] ..... H01J 43/20

[52] U.S. Cl. ..... 313/533; 313/534; 313/537; 313/103 R; 313/105 R

[58] Field of Search ..... 313/533, 534, 528, 529, 313/103 R, 103 CM, 105 R, 105 CM, 537, 379, 382, 383

[56] References Cited

U.S. PATENT DOCUMENTS 2,868,994 1/1959 Anderson ..... 313/105 X
2,908,840 10/1959 Anderson ..... 313/105 X
3,444,414 5/1909 Betoule et al. ..... 313/105 R X
4,431,943 2/1984 Faulkner et al. ..... 313/533
4,855,642 8/1989 Helvy et al. ..... 313/532

FOREIGN PATENT DOCUMENTS 2291654 3/1990 Japan .

*Primary Examiner*—Donald J. Yusko
*Assistant Examiner*—Ashok Patel
*Attorney, Agent, or Firm*—Cushman, Darby & Cushman

[57] ABSTRACT

A photomultiplier for receiving incident light on a photocathode, and cascade-multiplying electrodes emitted from the photocathode by a secondary electronic effect of a plurality of dynodes, whereby the incident light is detected. The photomultiplier includes a slowing-down electrode for decelerating those of secondary electrons emitted from a dynode on the first stage to a dynode on the second stage which have a higher speed. Because of the slowing-down electrode the secondary electrons having a higher speed are selectively decelerated, whereby a transit time spread of the secondary electrons emitted from parts of the first stage-dynode to the second stage-dynode is relatively decreased.

24 Claims, 8 Drawing Sheets

PHOTOMULTIPLIER

FIELD OF THE INVENTION

This invention relates to a photomultiplier for detecting very feeble light by cascade-multiplying photoelectrons by using a number of dynodes, and more specifically to a photomultiplier which can decrease spreads of electron transit times in cascade-photomultiplication of electrons, and is suitable to measure high-speed light pulses in fields of fluorescence lifetime measurement and high-energy physics.

BACKGROUND OF THE RELATED ART

A structure of the photomultiplier is examplified in Japanese Patent Laid-Open Publication No. 291654/1990 and is shown in FIG. 1.

The photomultiplier of FIG. 1 is of the so-called head-on type. In a glass tube 101 there are provided a photocathode 103 on an inside wall thereof, a focusing electrode 102, dynodes 104~113, and anodes 114. The voltage distribution of 350~1200 V which is increased toward the anodes 114 is applied to the dynodes 104~113. A pole electrode 115 is disposed between the first dynode 104 and the second dynode 105 for accelerating secondary electrons generated by the first dynode 104. A voltage sufficiently higher than that applied to the first dynode 104 (e.g., the same voltage as that applied to the fourth anode 107) is applied to the pole electrode 115.

When light is incident on a photocathode 103, photoelectrons are liberated. These photoelectrons are gathered to the focusing electrode 102 and sent to the first dynode 104. In the first dynode 104, secondary electrons are liberated by these photoelectrons and sent to the second dynode 105. The thus-generated secondary electrons at each of the following dynodes 105~113 are sent sequentially to its next dynode to be multiplied (cascade-multiplied), and multiplied photoelectrons are taken out finally at the anodes 114.

In the photoelectric multiplier of FIG. 1, a pole electrode 115 is disposed behind the third dynode 106, and the pole electrode 115 has a higher potential than the third dynode 106. Because of the presence of the pole electrode 115 at such position, which has a higher potential than the third dynode 106, an equipotential line E is bulged toward the first dynode 104. Because of such distribution of the equipotential line E, the secondary electrons emitted from the first dynode 104 are more accelerated when they transit toward the second dynode 105. Consequently an electron transit time of the emitted secondary electrons as a whole is shortened, whereby a spread of the electron transit time is relatively decreased.

In the acceleration of the secondary electrons by the above-described pole electrode 115, secondary electrons generated near the pole electrode 115 behind the dynode 104 are more accelerated. But secondary electrons emitted remote from the pole electrode 115 are less accelerated because their orbits are spaced from tile pole electrode 115. Consequently spreads (TTS's) of electron transit times cannot be sufficiently suppressed. As high-speed very feeble light pulse measurement, such as fluorescence lifetime measurement, time-resolved spectroscopy, etc., has been recently improved, photomultipliers having better transient response characteristics are needed.

SUMMARY OF THE INVENTION

An object of this invention is to provide a photomultiplier which can sufficiently suppress spreads of electron transit times, and has good transient response characteristics.

This invention has been made to solve the above-described problems, and a photomultiplier according to this invention for receiving incident light on a photocathode and cascade-multiplying by secondary electronic effect of a plurality of dynodes electrons emitted from the photocathode for the detection of the incident light comprises a slowing-down electrode for decelerating those of secondary electrons emitted from a dynode on the first stage to a dynode on the second stage which have a higher speed.

Generally in a photomultiplier, sequentially increasing voltages are applied to dynodes at respective stages of the cascade multiplication. Voltages to the dynodes at the respective stages, and a geometrical arrangement of the dynodes make up electric potentials. The potentials influence a speed of the secondary electrons and cause differences in a time in which the secondary electrons reach a next dynode.

In the photomultiplier according to this invention, a slowing-down electrode is provided so that those of secondary electrons emitted from the dynode on the first stage to the dynode of the second stage which have higher speeds are selectively slowed down, whereby a spread of transit times of the secondary electrons emitted from the dynode on the first stage to the dynode on the second stage is diminished.

The photomultiplier according to this invention may include an accelerating electrode for accelerating those of the secondary electrons emitted from the first stage-dynode to the second stage-synode which have a lower speed.

The photomultiplier according to this invention may include an orbit correcting electrode for correcting electron orbits of those of the secondary electrons emitted from the first-stage dynode to the second-stage dynode which pass near the third-stage dynode,

DESCRIPTION OF THE PREFERRED EMBODIMENTS

Figure 3:
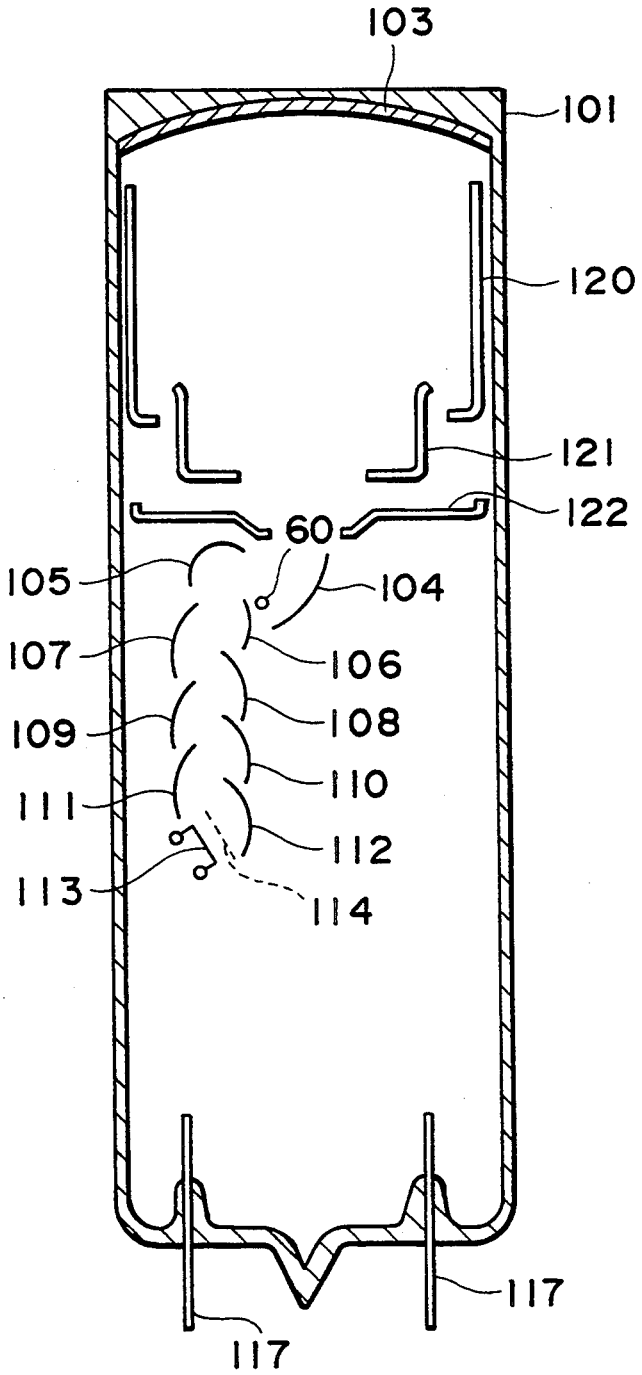
FIG. 3 is a schematic end view of the photomultiplier according to this invention.

The photomultiplier according to this invention, and preferred embodiments of the photomultiplier will be explained below with reference to the drawings attached hereto. The same or equivalent members of this invention as or to those of the above-described conventional photomultiplier will be briefed or will not be explained. FIG. 3 shows one example of the so-called head-on type photomultiplier.

A photocathode 103 is formed on an inner side of a glass tube 101. On the inner side of glass tube 101, focusing electrodes 120, 121 are held by a holding electrode 122. The focusing electrodes 120, 121 not only converge photoelectrons emitted from the photocathode 103, but also decrease a spread of the electron transit time of the emitted photoelectrons from the photocathode 103 take to arrive at the first dynode 104.

The first dynode 104 is arranged so as to agree with the opening of the holding electrode 122 and has a shape in which distances from points on the surface of the first dynodes 104 to the second dynode 105 are substantially constant. The dynodes 104~113 have geometric structures and arrangements which allow the same to receive the secondary electrons emitted from the dynodes on their preceding stages and converge the received secondary electrons to the dynodes on their following stages to output the electrons. The voltage distribution is applied to the dynodes 104~113. By this structure the photoelectrons emitted from the photocathode 103 are cascade-multiplied. Anodes 114 are disposed spaced from each other on the side of emission of secondary electrons of the flat dynode 113 on the final stage.

Figure 4A:
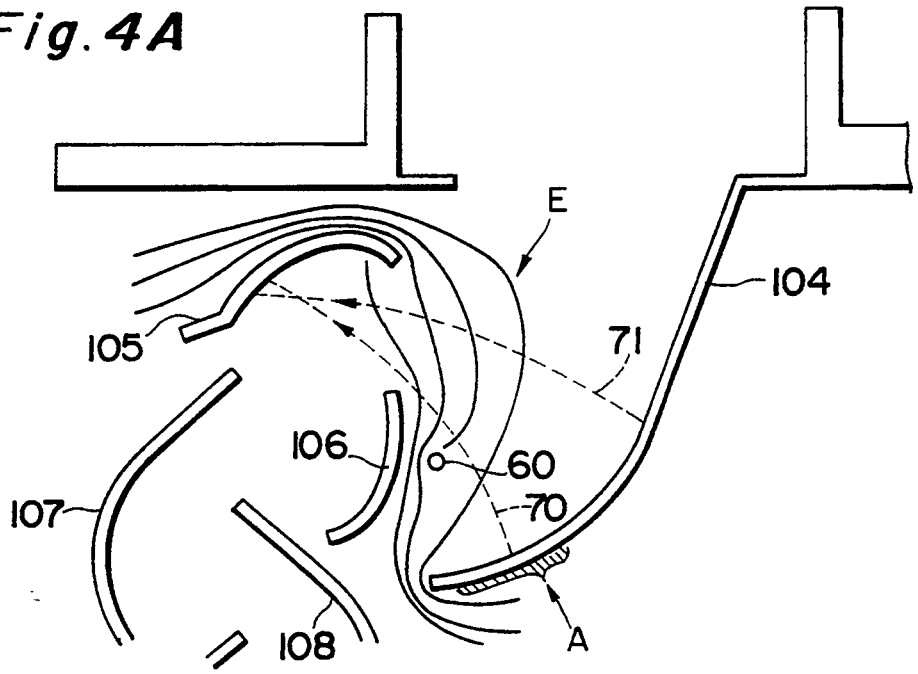
FIG. 4A is an enlarged view of a part of the arranged dynodes according to the present invention.

FIG. 4A shows an enlarged view of a part of a plurality of arranged dynodes.

The first dynode 104 and the second dynode 105 are opposed to each other, and the third dynode 106 are so arranged that a part of the third dynode 106 is confronted with electron orbits of secondary electrons emitted from the first dynode 104 to the second dynode 105. A slowing-down electrode 60 is disposed behind the third dynode 106 and is electrically connected to the second dynode 105 by a lead wire 81 (see FIG. 6). Consequently the slowing-down electrode 60 has the same potential as the second dynode 105 and has a potential lower than the neighboring third dynode 106.

Here the function of the slowing-down electrode 60 will be explained.

Figure 2:
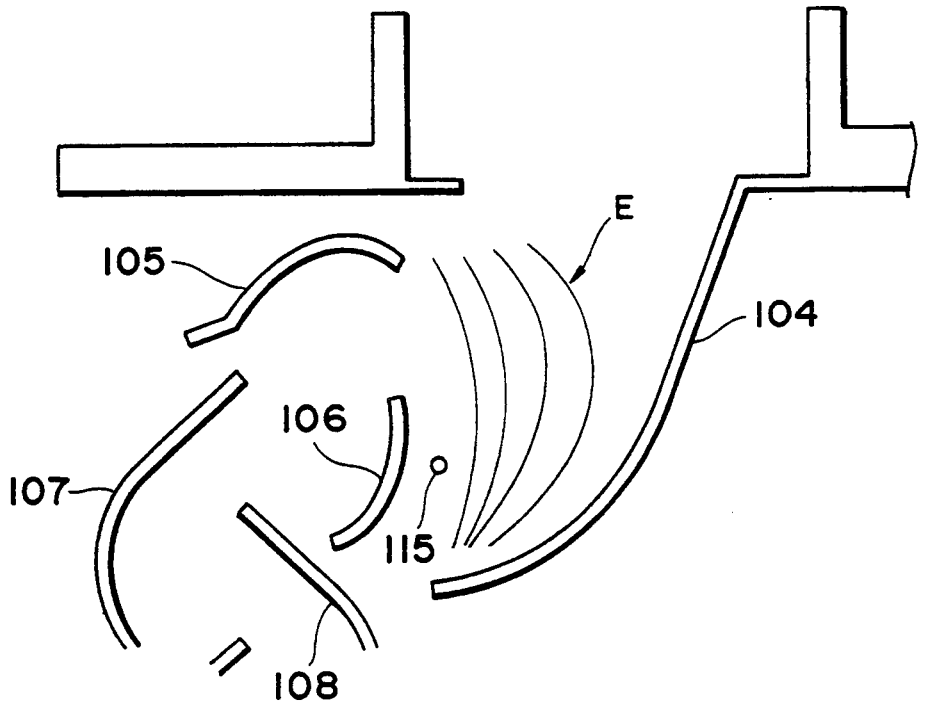
Fig. 2 (PRIOR ART)
FIG. 2 is an enlarged view of a part of the arranged dynodes of a conventional photomultiplier.

FIG. 4A shows a distribution of an equipotential line E in a case that the slowing-down electrode 60 is provided. In comparison with a distribution of FIG. 2 with an accelerating electrode 115 provided, a potential formed by the third dynode 106 is less bulged. Consequently the slowing-down electrode 60 functions so that the secondary electrons emitted from a territory A of the first dynode 104 are less accelerated, and a transit time of the secondary electrons emitted for the territory A to the second dynode 105 becomes longer.

TABLE 1 shows one example of operational conditions, as of the voltage distribution applied to the photomultiplier.

TABLE 1

| Electrode | Applied Voltage (V) | Potential Difference from Photocathode (V) |
|---|---|---|
| Photocathode (103) | −2250.0 | 0 |
| Grid 1 (120) | −2079.0 | 171.0 |
| Acc (121) | −527.0 | 1723.0 |
| 1st Dynode (104) | −1448.0 | 802.0 |
| Slowing-down Electrode (60) | −1290.0 | 960.0 |
| Accelerating Electrode (61) | −922.0 | 1328.0 |
| 2nd Dynode (105) | −1290.0 | 960.0 |
| 3rd Dynode (106) | −1053.0 | 1197.0 |
| 4th Dynode (107) | −922.0 | 1328.0 |
| 5th Dynode (108) | −790.0 | 1460.0 |
| 6th Dynode (109) | −658.0 | 1592.0 |
| 7th Dynode (110) | −527.0 | 1723.0 |
| 8th Dynode (111) | −395.0 | 1855.0 |
| 9th Dynode (112) | −263.0 | 1987.0 |
| 10th Dynode (113) | −132.0 | 2118.0 |
| Anode Electrode (114) | 0.0 | 2250.0 |

Figure 5A:
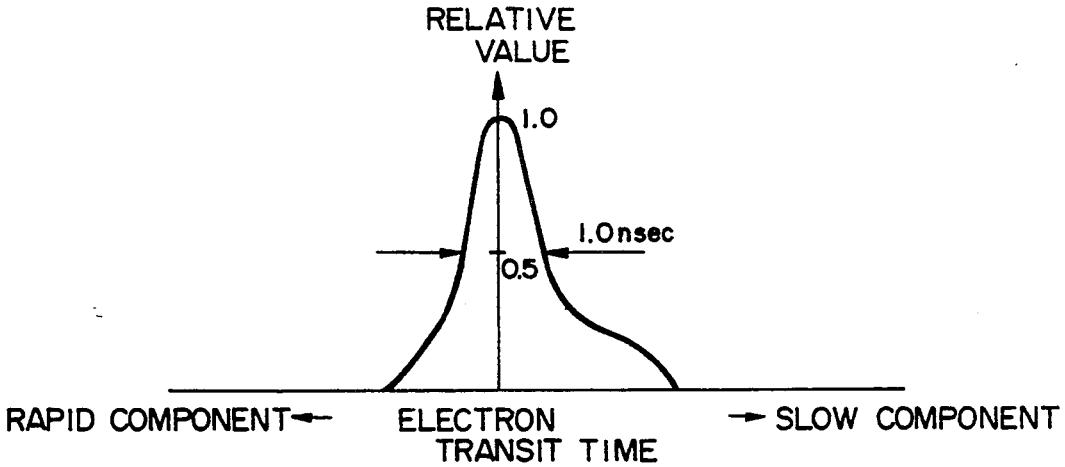
Fig. 5A (PRIOR ART)
FIG. 5A is a graph of electron transit time spreads of the conventional photomultiplier.
Figure 5B:
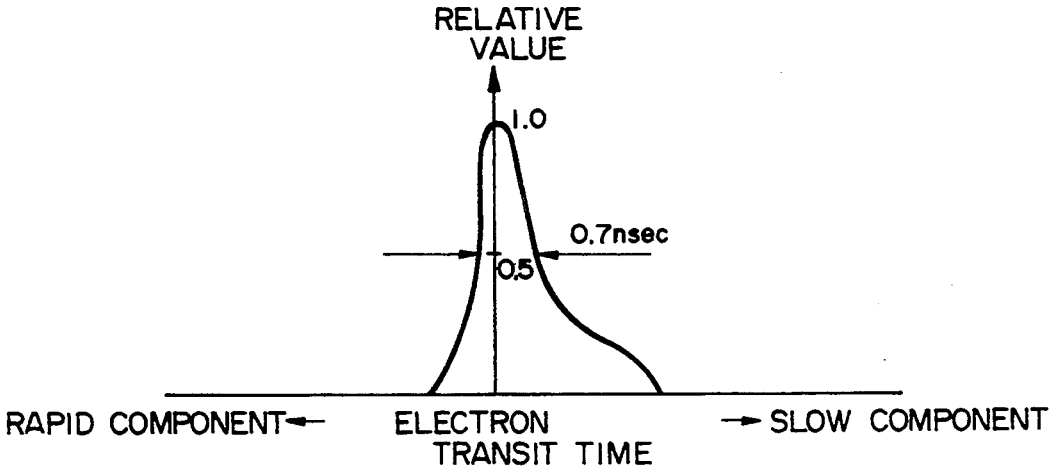
FIG. 5B is a graph of electron transit time spreads of the photomultiplier of FIG. 4A.
Figure 5C:
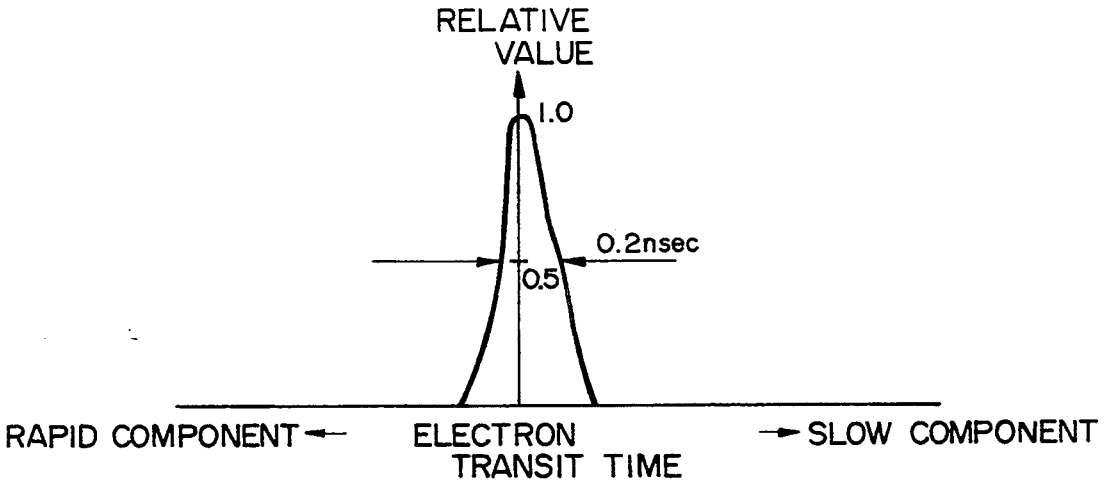
FIG. 5C is a graph of electron transit time spreads of the photomultiplier of FIG. 4B.
Figure 5D:
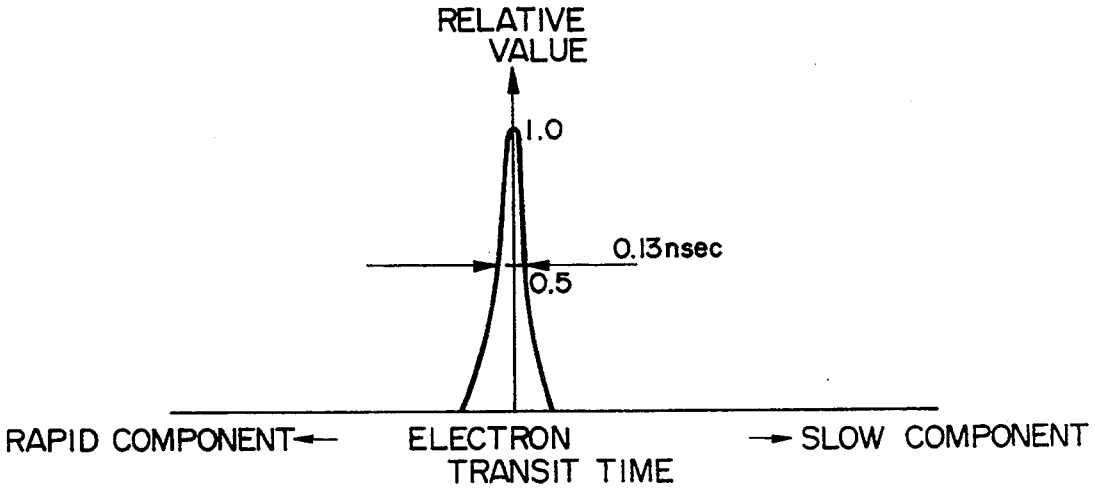
FIG. 5D is a graph of electron transit time spreads of the photomultiplier of FIG. 4C.

An electron orbit 70 of a shorter transit time than those of the secondary electrons emitted from the first dynode 104 to the second dynode 105, which have a shorter transit time, and an electron orbit 71 of those of the same, which have a longer transit time under the operational conditions of TABLE 1 are shown in FIG. 4A. The electrons having a shorter transit time (the electron orbit 70) take 850 psecs to arrive at the second dynode 105, and the electrons having a longer transit time (the electron orbit 71) take 1100 psecs to arrive at the second dynode 105. The difference between these transit times is 250 psecs. In the prior art, as described in Japanese Patent Laid-Open Publication No. 291654/1990, the transit time is more than 500 psecs. A transit time spread is decreased. FIG. 5A shows a distribution of the transit times of the prior art and FIGS. 5B through 5D show distribution of the transit times of the embodiments of the present invention. In the transit time distribution (FIG. 5B), because of the slowing-down electrode 60, the shorter transit time in the transit time distribution of the prior art (FIG. 5A) is shifted to the longer transit time component, and the longer transit time component is shifted to the shorter time transit component. It is seen that, as a result, the half-value is width narrower.

Figure 4B:
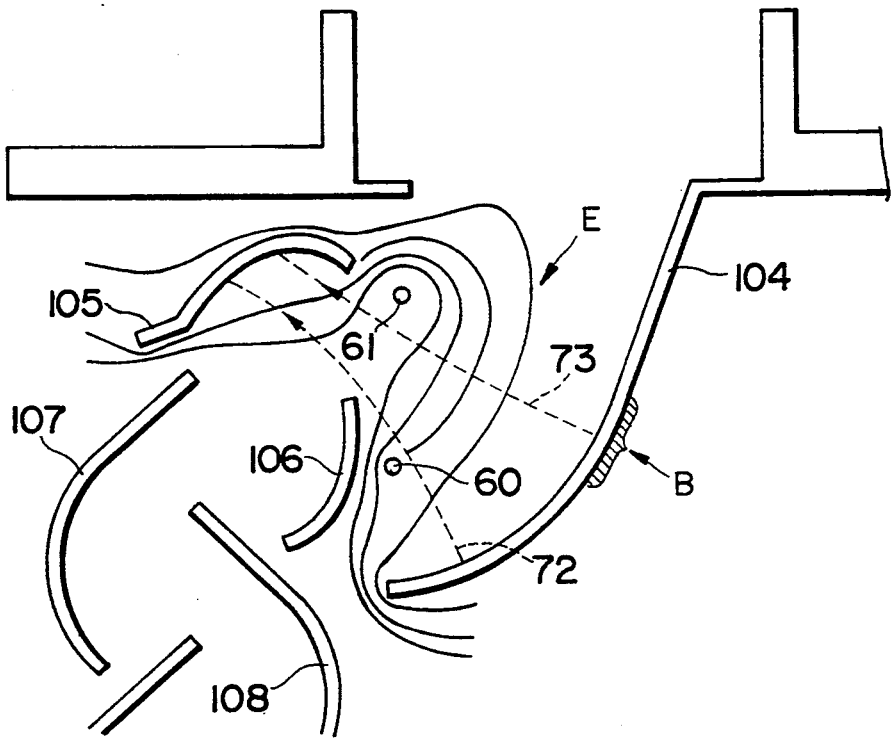
FIG. 4B is an enlarged view of a part of an arrangement of dynodes according to the present invention.
Figure 6:
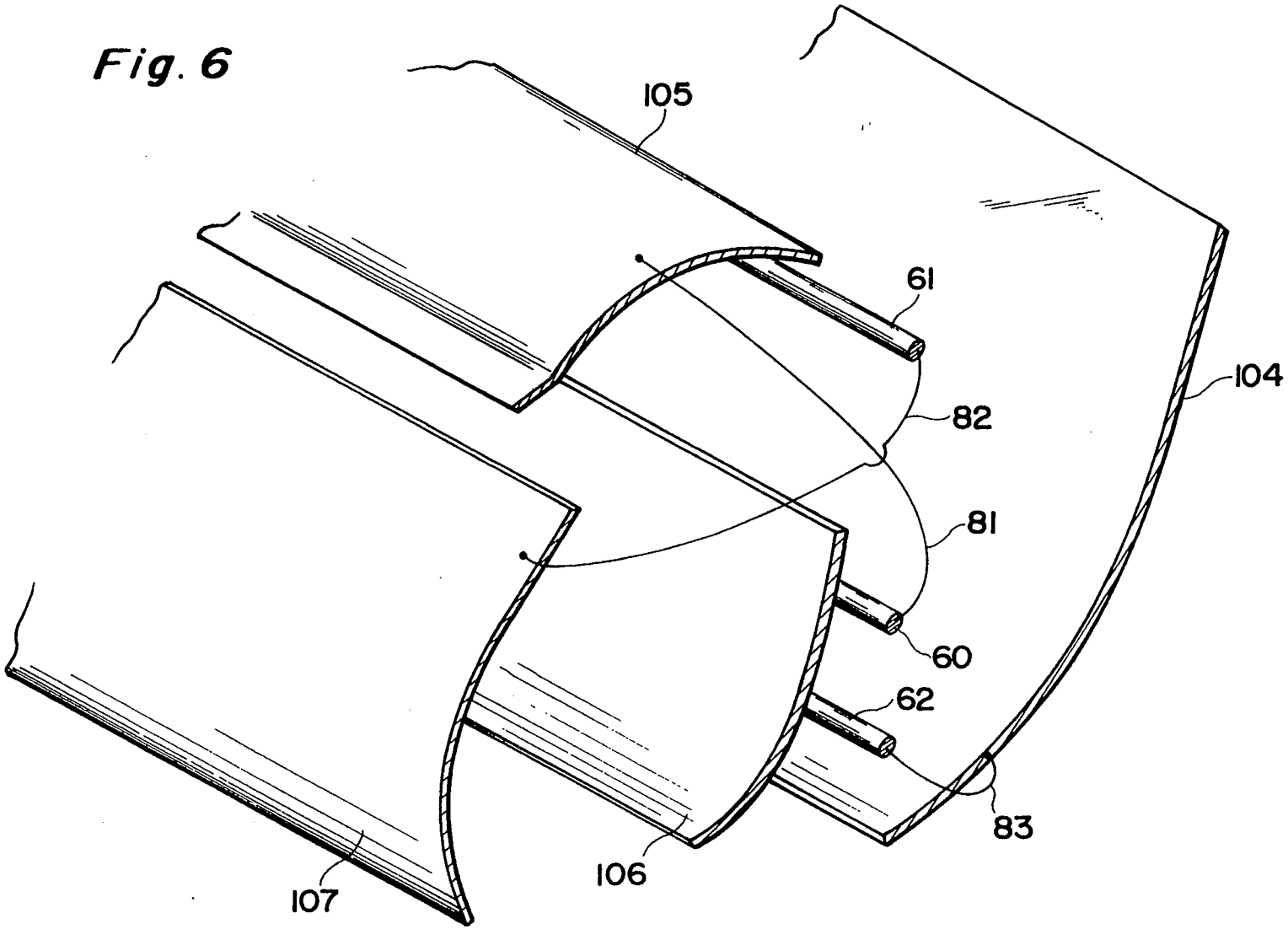
FIG. 6 is a perspective view of a part of an arrangement of dynodes according to the present invention.

FIG. 4B shows another embodiment of this invention. The photoelectric multiplier according to this invention includes, in addition to the slowing-down electrode 60, an accelerating electrode 61 disposed further above the slowing-down electrode 60. The accelerating electrode 61 is positioned near electron orbits of the secondary electrons passing remote from the third dynode 106 so as to accelerate the secondary electrons, which are less influenced in this area by a potential of the third dynode 108. Accordingly the accelerating electrode 61 is connected to the fourth dynode 107 by a lead wire 82 and has a higher potential than the third dynode 106 (FIG. 6).

It is seen in FIG. 4B that because of the accelerating electrode 81, the equipotential line E is more bulged toward the first dynode 104 in that area, i.e., the area remote from the third dynode 106. As a result, the secondary electrons passing through the area remote from the third dynode 106 are more accelerated, and a transit time of the secondary electrons passing through this area is shortened.

Figure 4C:
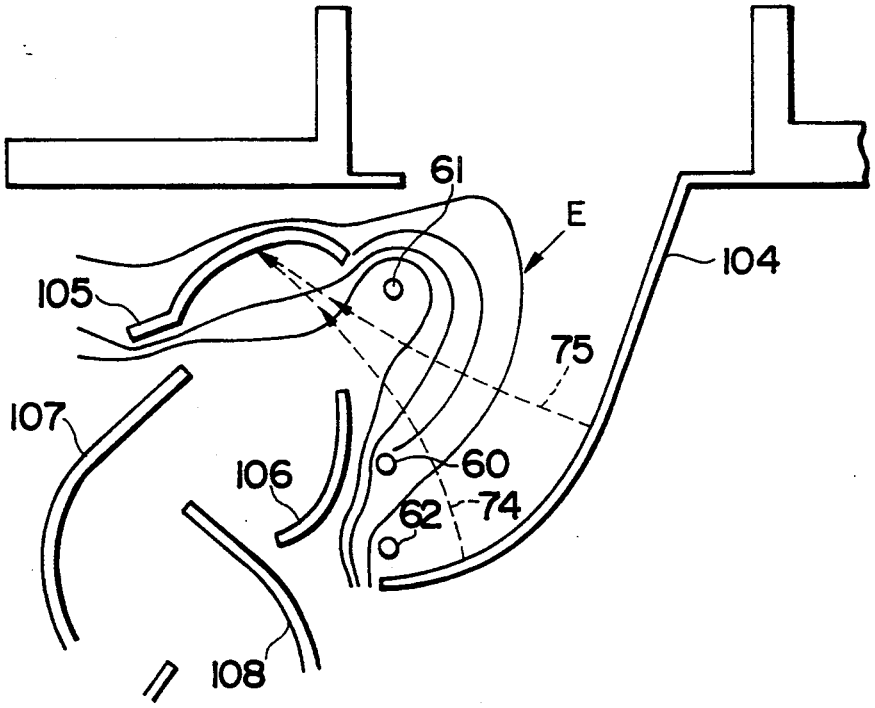
FIG. 4C is an enlarged view of a part of an arrangement of dynodes according to the present invention.

An electron orbit 72 of those of the secondary electrons emitted from the first dynode 104 to the second dynode 105, which have a shorter transit time, and an electron orbit 73 of those of the same, which have a longer transit time under the operational conditions of TABLE 1 are shown. The electrons having a shorter transit time (the electron orbit 72) take 780 psecs to reach the second dynode 105, and the electrons having a longer transit time (the electron orbit 73) take 880 psecs to get to the second dynode 105. The difference between these transit times is 100 psecs, and the distribution of these transit times is as shown in FIG. 5C. The transit time spread is much improved in comparison with that of the prior art shown in FIG. 5A. FIG. 4C shows an embodiment of the photomultiplier according to this invention having improved transit time spreads.

The photomultiplier according to this embodiment further includes an orbit correcting electrode 62 between the first dynode 104 and the second dynode 105. The orbit correcting electrode 62 is for suppressing the influence by the third dynode 106 having a higher potential than the first and the second dynodes 104,105, and has a lower potential than the third dynode 106. In this embodiment, the orbit correcting electrode 62 and the first dynode 104 are connected by a lead wire 83 to set both at the same potential.

Figure 1:
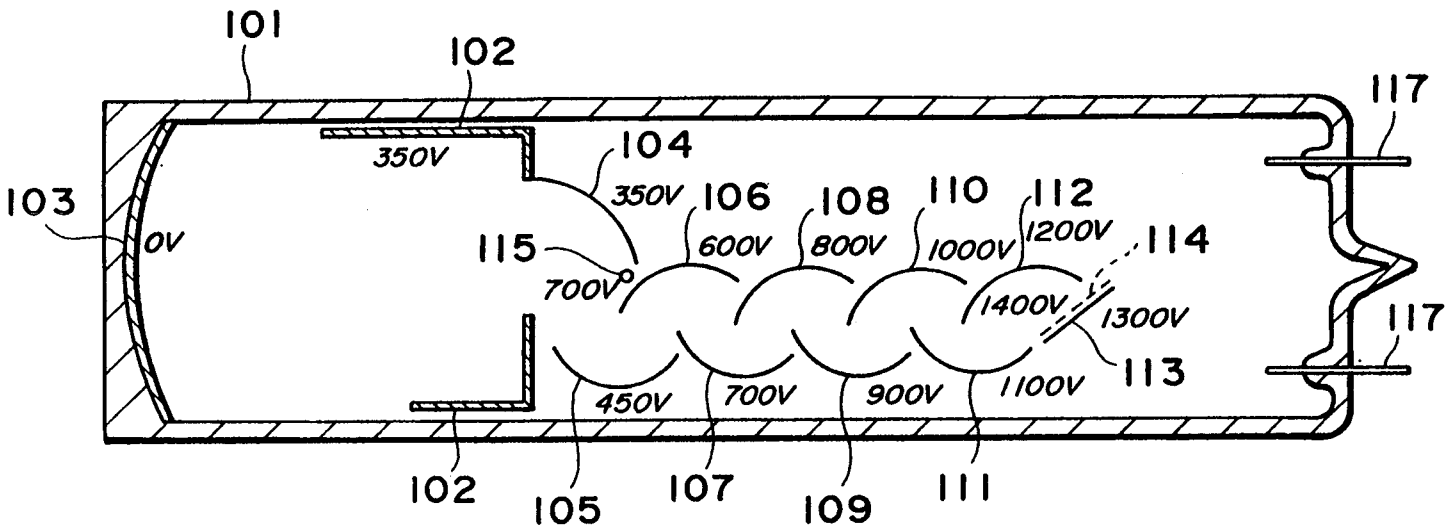
Fig. 1 (PRIOR ART)
FIG. 1 is a schematic end view of a conventional photomultiplier.

As seen in FIG. 4C, because of the orbit correcting electrode 62, the equipotential line E is suppressed from bulging toward the first dynode 104 in this territory. As a result, the electrons which are accelerated by the third dynode 106 in FIG. 1.are not accelerated, and the electron orbits are converged. The difference between the transit times is further decreased.

In a simulation, the electrons having a shorter transit time (the electron orbit 74) take 840 psecs to arrive at the second dynode 105, and the electrons having a longer transit time (the electron orbit 75) take 890 psecs. The difference between these transit times is 50 psecs, and a distribution of the transit times is as shown in FIG. 5D. A transit time spread is more decreased in comparison with that of the prior art of FIG. 5A. Owing to the convergence of the electron orbits, spreads which take place after the second dynode 105 can be suppressed.

Thus, according to the photomultiplier of this invention, transit time spreads of the secondary electrons can be much suppressed. As a result, transient response characteristics of photodetection can be much improved. Since a time resolving power depends on a transient response characteristic, the photomultiplier according to this invention enables high time-resolved spectrometry.

This invention is not limited to the above-described embodiments and should be constructed to cover various modifications and variations.

For example, the above-described embodiments have been explained by means of head-on type, but this invention is applicable to a side-on type. In the above-described embodiments, electrons are cascade-multiplied by ten stages of dynodes, but the number of stages may be larger or smaller than the above described embodiments.

I claim:

1. A photomultiplier light, comprising:

a photocathode for receiving incident light;

an anode;

a dynode unit having a plurality of stages disposed between the photocathode and the anode for cascade multiplying electrons emitted by the photocathode, the dynode unit including:

i.) a first-stage dynode for receiving electrons emitted from the photocathode and for emitting secondary electrons, the first-stage dynode adapted to have a predetermined potential ii.) a second-stage dynode disposed opposite to the first-stage dynode for receiving the secondary electrons emitted from the first-stage dynode and for emitting secondary electrons, the second-stage dynode adapted to have a higher potential than the first stage dynode and iii.) a third-stage dynode disposed opposite to the second-stage dynode for receiving the secondary electrons emitted from the second-stage dynode and for emitting secondary electrons, the third-stage dynode adapted to have a higher potential than the second-stage dynode, the third stage dynode being so disposed that a part of the third-stage dynode confronts electron orbits of the secondary electrons which are emitted from the first-stage dynode and are received by the second-stage dynode; and a slowing-down electrode for decelerating the secondary electrons having a higher speed among the secondary electrons emitted from the first-stage dynode for reception by the second-stage dynode, the slowing-down electrode being disposed in a space near the third-stage dynode, and adapted to have a potential within a range between the potential of the first-stage dynode and the potential of the third-stage dynode, the space being passed through by the secondary electrons emitted from the first-stage dynode for reception by the second-stage dynode.

2. A photomultiplier according to claim 1, wherein the slowing-down electrode is adapted to have a same potential as the second-stage dynode.

3. A photomultiplier according to claim 2, wherein the slowing-down electrode has the same potential as the second-stage dynode.

4. A photomultiplier according to claim 1, further comprising an accelerating electrode for accelerating lower-speed electrons among the secondary electrons emitted from the first-stage dynode for reception by the second-stage dynode, the accelerating electrode disposed in the space.

5. A photomultiplier according to claim 4, wherein the accelerating electrode is adapted to have a higher potential than the second-stage dynode.

6. A photomultiplier according to claim 5, further comprising:

a fourth-stage dynode disposed opposite the third-stage dynode and adapted to have a potential higher than the third-stage dynode;

the accelerating electrode is adapted to have a same potential as the fourth-stage dynode; and the slowing-down electrode is adapted to have a same potential as the second-stage dynode.

7. A photomultiplier according to claim 6, wherein the accelerating electrode is electrically connected to the fourth-stage dynode, and the slowing-down electrode is electrically connected to the second-stage dynode.

8. A photomultiplier according to claim 4, further comprising an orbit correcting electrode for correcting electron orbits of those of the secondary electrons emitted from the first-stage dynode which have an orbit near the third-stage dynode, the orbit correcting electrode being disposed between the first-stage dynode and the slowing-down electrode.

9. A photomultiplier according to claim 8, wherein the orbit correcting electrode is adapted to have a potential within a range between the potentials of the first-stage dynode and the slowing-down electrode.

10. A photomultiplier according to claim 9, wherein:

the orbit correcting electrode is adapted to have a same potential as the first-stage dynode;

the slowing-down electrode is adapted to have a same potential as the second-stage dynode; and the accelerating electrode is adapted to have a same potential as the fourth-stage dynode.

11. A photomultiplier according to claim 10, wherein:

the orbit correcting electrode is electrically connected to the first-stage dynode;

the slowing-down electrode is electrically connected to the second-stage dynode; and the accelerating electrode is electrically connected to the fourth-stage dynode.

12. A photomultiplier, comprising:

a photocathode for receiving incident light;

an anode; and a dynode unit disposed between the photocathode and the anode for cascade-multiplying electrons omitted from the photocathode, the dynode unit comprising:

i.) a first dynode adapted to have a predetermined potential, the first dynode emitting secondary electrons;

ii.) a second dynode disposed opposite to the first dynode, adapted to have a higher potential than the first dynode; and iii.) a third dynode disposed opposite to the second dynode, adapted to have a higher potential than the second dynode; and a first electrode for decelerating secondary electrons emitted from the first dynode which have a higher speed, the first electrode being disposed in a space near the third dynode and adapted to have a potential within a range between a potential of the first dynode and a potential of the third dynode, the space being passed through by the secondary electrons emitted from the first dynode.

13. A photomultiplier according to claim 12, wherein the first electrode is adapted to have a same potential as the second dynode.

14. A photomultiplier according to claim 13, wherein the first electrode is electrically connected to the second dynode.

15. A photomultiplier according to claim 12, further comprising a second electrode for accelerating secondary electrons emitted from the first dynode which have a lower speed, the second electrode disposed in the space passed through by the secondary electrons emitted from the first dynode which have a lower speed.

16. A photomultiplier according to claim 15, wherein the second electrode is adapted to have a higher potential than the second dynode.

17. A photomultiplier according to claim 16, further comprising:

a fourth dynode disposed opposite to the third dynode and adapted to have a higher potential than the third dynode;

the first electrode is adapted to have a same potential as the second dynode; and the second electrode is adapted to have a same potential as the fourth dynode.

18. A photomultiplier according to claim 17 wherein:

the first electrode is electrically connected to the second dynode; and the second electrode is electrically connected to the fourth dynode.

19. A photomultiplier, comprising:

a photocathode for receiving incident light;

an anode; and a dynode unit disposed between the photocathode and the anode for cascade-multiplying electrons emitted from the photocathode, the dynode unit comprising:

i.) a first dynode adapted to have a predetermined potential;

ii.) a second dynode disposed opposite to the first dynode, adapted to have a higher potential than the first dynode; and iii.) a third dynode disposed opposite to the second dynode, adapted to have a higher potential than the second dynode; and a first electrode for decelerating secondary electrons emitted from the first dynode which have a higher speed, the first electrode being disposed in a space near the third dynode, the space being passed through by the secondary electrons emitted from the first dynode;

a second electrode for accelerating secondary electrons emitted from the first dynode which have a lower speed, the first electrode being disposed in the space passed through by the secondary electrons emitted from the first dynode; and a third electrode for correcting secondary electrons emitted from the first dynode which have an orbit near the third dynode, the third electrode being disposed between the first dynode and the first electrode.

20. A photomultiplier according to claim 19, wherein the first electrode is adapted to have a potential within a range between the potential of the first dynode and the potential of the third dynode.

21. A photomultiplier according to claim 19, wherein the second electrode is adapted to have a higher potential than the second dynode.

22. A photomultiplier according to claim 19, wherein the third electrode is adapted to have a potential within a range between the potential of the first dynode and the potential of the first electrode.

23. A photomultiplier according to claim 19, wherein:

the first electrode is adapted to have a same potential as the second dynode;

the second electrode is adapted to have a same potential as a fourth dynode; and the third electrode is adapted to have a same potential as the first dynode.

24. A photomultiplier according to claim 23, wherein:

the first electrode is electrically connected to the second dynode;

the second electrode is electrically connected to the fourth dynode; and the third electrode is electrically connected to the first dynode.

* * * * *